US008465178B2

(12) United States Patent
Wilcox et al.

(10) Patent No.: US 8,465,178 B2
(45) Date of Patent: Jun. 18, 2013

(54) LED LIGHTING FIXTURE

(75) Inventors: Kurt S. Wilcox, Libertyville, IL (US); Wayne Guillien, Franksville, WI (US); Frank Tsao, Cleveland (AU)

(73) Assignee: Cree, Inc., Durham, NC (US)

( * ) Notice: Subject to any disclaimer, the term of this patent is extended or adjusted under 35 U.S.C. 154(b) by 141 days.

(21) Appl. No.: 12/876,817

(22) Filed: Sep. 7, 2010

(65) Prior Publication Data

US 2012/0057351 A1 Mar. 8, 2012

(51) Int. Cl.
*F21V 29/00* (2006.01)

(52) U.S. Cl.
USPC ..... 362/294; 362/373; 362/362

(58) Field of Classification Search
USPC ..... 362/294, 373, 362, 377, 375, 376, 362/332, 249.02, 147, 800
See application file for complete search history.

(56) References Cited

U.S. PATENT DOCUMENTS

| | | | | |
|---|---|---|---|---|
| D98,924 | S | 3/1936 | Fassin | |
| D186,718 | S | 11/1959 | Summers | |
| 3,124,308 | A | 3/1964 | Goldstein | |
| D200,118 | S | 1/1965 | Steenhoven | |
| D219,546 | S | 12/1970 | Kaiser et al. | |
| D228,361 | S | 9/1973 | Burns et al. | |
| D233,852 | S | 12/1974 | Czellath et al. | |
| D257,892 | S | 1/1981 | Dean et al. | |
| 4,462,068 | A | 7/1984 | Shadwick | |
| 4,709,312 | A | 11/1987 | Heinisch | |
| D298,656 | S | 11/1988 | Compton | |
| D326,728 | S | 6/1992 | Layne | |
| 5,613,766 | A | 3/1997 | Raouf | |
| D434,515 | S | 11/2000 | McNamara | |
| 6,174,067 | B1 * | 1/2001 | Thrasher et al. | 362/101 |
| 6,422,709 | B1 | 7/2002 | Panagiotou | |
| D544,125 | S | 6/2007 | Guercio | |
| D545,471 | S | 6/2007 | Guercio | |
| D545,472 | S | 6/2007 | Guercio | |
| D545,987 | S | 7/2007 | Guercio | |
| D549,380 | S | 8/2007 | Guercio | |
| D550,387 | S | 9/2007 | Giercio | |
| D550,392 | S | 9/2007 | Guercio | |
| D552,282 | S | 10/2007 | Guercio | |
| D552,283 | S | 10/2007 | Guercio | |
| D555,821 | S | 11/2007 | Russello et al. | |
| D562,491 | S | 2/2008 | DiCola | |
| D563,587 | S | 3/2008 | Quiogue et al. | |
| D565,223 | S | 3/2008 | Guercio | |
| D573,288 | S | 7/2008 | Xu et al. | |
| D592,346 | S | 5/2009 | Gill | |
| 7,631,993 | B2 * | 12/2009 | Russello et al. | 362/374 |

(Continued)

OTHER PUBLICATIONS

Excerpts of e-conolight brochure. Date: May/Jun. 2010. 4 pages.

(Continued)

*Primary Examiner* — Peggy A. Neils
(74) *Attorney, Agent, or Firm* — Jansson Munger McKinley & Shape Ltd.

(57) ABSTRACT

An LED lighting fixture including a housing having a hollow interior cavity defined by a backwall and a surrounding wall extending therefrom to a forward edge. An LED illuminator is mounted in the housing. An LED-support structure extends in the interior cavity from the housing to an LED-supporting surface positioning the LED illuminator in a desired orientation and spaced from the backwall. The LED-support structure is a heat sink transferring heat from the LED illuminator to the housing.

22 Claims, 9 Drawing Sheets

U.S. PATENT DOCUMENTS

| | | | | |
|---|---|---|---|---|
| 7,651,245 | B2 * | 1/2010 | Thomas et al. | 362/294 |
| D610,296 | S | 2/2010 | Boissevain et al. | |
| D612,975 | S | 3/2010 | Guercio et al. | |
| 7,670,029 | B1 * | 3/2010 | Luo et al. | 362/294 |
| 7,674,013 | B2 * | 3/2010 | Leslie et al. | 362/249.05 |
| D614,790 | S | 4/2010 | Nibaldi | |
| D625,038 | S | 10/2010 | Yoo | |
| 7,854,616 | B2 * | 12/2010 | Janos et al. | 439/76.1 |
| 7,874,700 | B2 * | 1/2011 | Patrick | 362/249.02 |
| D634,878 | S | 3/2011 | Guercio et al. | |
| D641,095 | S | 7/2011 | Yao et al. | |
| D641,908 | S | 7/2011 | McKee | |
| D644,370 | S | 8/2011 | Lickiss | |
| 8,021,025 | B2 * | 9/2011 | Lee | 362/373 |
| D650,112 | S | 12/2011 | Bryant | |
| 8,152,334 | B2 * | 4/2012 | Krogman | 362/249.02 |
| 2007/0230172 | A1 * | 10/2007 | Wang | 362/249 |
| 2008/0080196 | A1 | 4/2008 | Ruud et al. | |
| 2009/0168416 | A1 | 7/2009 | Zhang et al. | |
| 2009/0262533 | A1 | 10/2009 | Liu et al. | |
| 2010/0072897 | A1 | 3/2010 | Zheng | |
| 2010/0085751 | A1 * | 4/2010 | Shaner | 362/249.02 |
| 2010/0238671 | A1 * | 9/2010 | Catone et al. | 362/373 |
| 2011/0013397 | A1 | 1/2011 | Catone et al. | |
| 2011/0194280 | A1 * | 8/2011 | Ruffin et al. | 362/235 |
| 2011/0286219 | A1 * | 11/2011 | Guercio et al. | 362/294 |
| 2012/0081911 | A1 * | 4/2012 | Horng et al. | 362/373 |

OTHER PUBLICATIONS

Excerpts from www.rabweb.com. RAB Lighting. Date: May 27, 2010. 2 pages.

Excerpts from www.gardcolighting.com. Gardco Lighting. Date: Copyright 2006. 4 pages.

Gardco Lighting brochure. Designer Flood Spot and Floodlighting. Copyright 2005.

Kim Lighting brochure. AFL2 Architectural floodlights 250 and 400 watt. Date: Oct. 1995.

Kim Lighting brochure. Micro Flood. Date: 1996.

Kim Lighting brochure. AFL Architectural floodlights. Date: 1996.

Kim Lighting brochure. CFL Series Compact Floodlight. Date: 1996.

Kim Lighting. AFL10 Architectural Floodlights Specification. Date: 2001.

Kim Lighting. Compact Flood Cast Aluminum Specification. Date: Unknown.

Kim Lighting brochure. the AFL family. Date: Oct. 1995.

Kim Lighting brochure. Kim Architectural Floodlights. Date: 1996.

Grandlite brochure. The Round Back Flood. 2 pages. Date: Jun. 2004.

Leotek brochure. LWS1 Series—LED Outdoor Wall Sconce. 2 pages. Date: Unknown.

* cited by examiner

LED LIGHTING FIXTURE

FIELD OF THE INVENTION

This invention relates to light fixtures. More particularly, this invention relates to light fixtures which utilize light-emitting diodes (LEDs) as the light source.

BACKGROUND OF THE INVENTION

In recent years, the use of LEDs for various common lighting purposes has increased, and this trend has accelerated as advances have been made in LEDs and in LED-array devices, often referred to as "LED modules." Indeed, lighting applications which have been served by fixtures using high-intensity discharge (HID) lamps and other light sources are now increasingly beginning to be served by LED fixtures. Creative work continues in the field of using LEDs for light fixtures in various applications.

High-luminance light fixtures using LEDs as the light source present particularly challenging problems. High cost due to high complexity becomes a particularly difficult problem when high luminance, reliability, and durability are essential to product success. Keeping electronic LED drivers in a water/air-tight location may also be problematic, particularly when the light fixtures are constantly exposed to the elements.

Dealing with heat dissipation requirements is still another problem area for high-luminance LED light fixtures. Heat dissipation is difficult in part because high-luminance LED light fixtures typically have many LEDs. Complex structures for module mounting and heat dissipation have sometimes been deemed necessary, and all of this adds complexity and cost.

Furthermore, previous fixtures utilizing HID lamps and other non-LED light sources typically require a comparatively large lamp compartment with large reflectors for lighting efficiency. Such fixtures often also require large ballast compartments. These often result in large overall fixture size and a substantially heavy fixture.

In short, there is a significant need in the lighting industry for improved light fixtures and the like using LEDs. There is a need for fixtures that satisfy the problems associated with heat dissipation and appropriate protection of electronic LED driver components. Finally, there is a need for an improved LED-module-based light which is relatively simple, compact and easy and inexpensive to manufacture.

OBJECTS OF THE INVENTION

It is an object of the invention to provide an improved LED lighting fixture that overcomes some of the problems and shortcomings of the prior art, including those referred to above.

Another object of the invention is to provide an improved LED lighting fixture that is readily adaptable for a variety of mounting positions and situations.

Another object of the invention is to provide an improved LED lighting fixture with both good protection of electronic LED drivers and excellent heat dissipation from LEDs and drivers.

Yet another object of the invention is to provide an improved LED lighting fixture providing desirable illumination.

Still another object of the invention is to provide an improved LED lighting fixture which is relatively simple and compact.

How these and other objects are accomplished will become apparent from the following descriptions and the drawings.

SUMMARY OF THE INVENTION

The present invention is an improvement in LED lighting fixtures. The inventive LED lighting fixture includes a housing having a hollow interior cavity defined by a backwall and a surrounding wall extending therefrom to a forward edge. An LED illuminator is mounted in the housing. And, an LED-support structure extends in the interior cavity from the housing to an LED-supporting surface which positions the LED illuminator in a desired orientation and is spaced from the backwall.

The LED-support structure is a heat sink transferring heat from the LED illuminator to the housing. It is preferred that the LED-support structure is substantially spaced from the surrounding wall. The LED lighting fixture preferably includes at least one interior rib connecting the LED-support structure to the surrounding wall.

In preferred embodiments of the inventive LED lighting fixture, the outer surface of the housing includes a series of fins extending outwardly therefrom. The fins provide further heat dissipation from the LED illuminator.

In some of such embodiments, the LED-support structure extends from the backwall. The housing and the LED-support structure may be preferably integrally formed with the outer surface of the backwall having a region free of outer fins. The housing and the LED-support structure are preferably formed by casting. It is preferred that a finned insert is secured to such region of the backwall free of outer fins such that the rear of the fixture is uniformly finned.

In preferred embodiments, the LED-support structure extends from the backwall. Such LED-support structure is preferably substantially hollow. And, the backwall has an aperture leading into the hollow LED-support structure which allows passage of wiring into the housing interior and to the LED illuminator. The hollow LED-support structure preferably defines an aperture into the housing interior for the passage of wiring into the housing interior from the backwall aperture.

The LED lighting fixture preferably includes an LED driver within the housing interior. It is preferred that the LED driver be secured against the housing, thereby transferring heat from the driver.

The backwall may be substantially planar with the surrounding wall including a wire passage into the housing interior. In such embodiments, a plurality of similar fixtures may be mounted along a mounting surface and powered with daisy-chain wiring.

In some preferred embodiments, the LED-supporting surface supports the LED illuminator substantially at the level of the forward edge of the surrounding wall. The LED lighting fixture preferably includes a cover closing the housing interior. Such cover may be made of suitable metal to serve as an electrical closure for the housing interior. The cover defines an LED aperture exposing the LED illuminator. It is preferred that the cover have a substantially white outer surface to reduce absorption of incident light.

The LED lighting fixture preferably includes a lens member over the LED illuminator and sealingly connected to the housing. The lens member preferably includes a lens portion configured for broad distribution of LED-emitted light and a flange portion about the lens portion. The housing preferably includes an outward collar about the forward edge of the surrounding wall. The flange portion of the lens member sealingly engages the outward collar to provide a weather seal to the housing interior. The LED lighting fixture may include a flange-adjacent gasket between the flange portion and the outward collar.

The LED illuminator is preferably a multi-chip LED module. The module may be a type of LED packages which include twenty five LEDs compactly placed close together and coated by a layer of phosphorus selected to produce different colors of white light such as warm, neutral and cool white light. Such LED packages are highly energy-efficient and have a long operating life.

These packages are compact, high-flux-density light sources. The compact size of such multi-chip LED packages is also highly desirable. They are typically round or square with a diameter or a side length of about 20-26 millimeters and a depth of about 3.5 millimeters. The relatively small dimensions of these modules permit significant reduction in the dimensions of lighting fixtures which utilize such high-luminance compact LED light sources.

Certain embodiments of the inventive LED lighting fixture further include a reflector cup which is positioned at the LED-supporting surface and surrounds the LED illuminator to reflect LED-emitted light in a desired direction. The LED-supporting surface is preferably positioned such that distal edges of the reflector cup are substantially at the level of the forward edge of the surrounding wall.

It is preferred that the LED lighting fixture of further includes a lens member over the LED illuminator and sealingly connected to the housing. The lens member may include a light-transmissive region over the reflector cup for transmitting LED-emitted light and a opaque region covering the housing interior.

The lens member is preferably substantially planar. It is preferred that the housing includes an outward collar about the forward edge of the surrounding wall. The lens member preferably sealingly engages the outward collar. The LED lighting fixture may further include a collar-adjacent gasket between the lens member and the outward collar.

In some alternative embodiments, the LED-supporting surface supports the LED illuminator at an acute angle with respect to the backwall.

The surrounding wall may includes a shield portion in position to intercept a portion of emitted light.

DETAILED DESCRIPTION OF PREFERRED EMBODIMENTS

Figure 1:
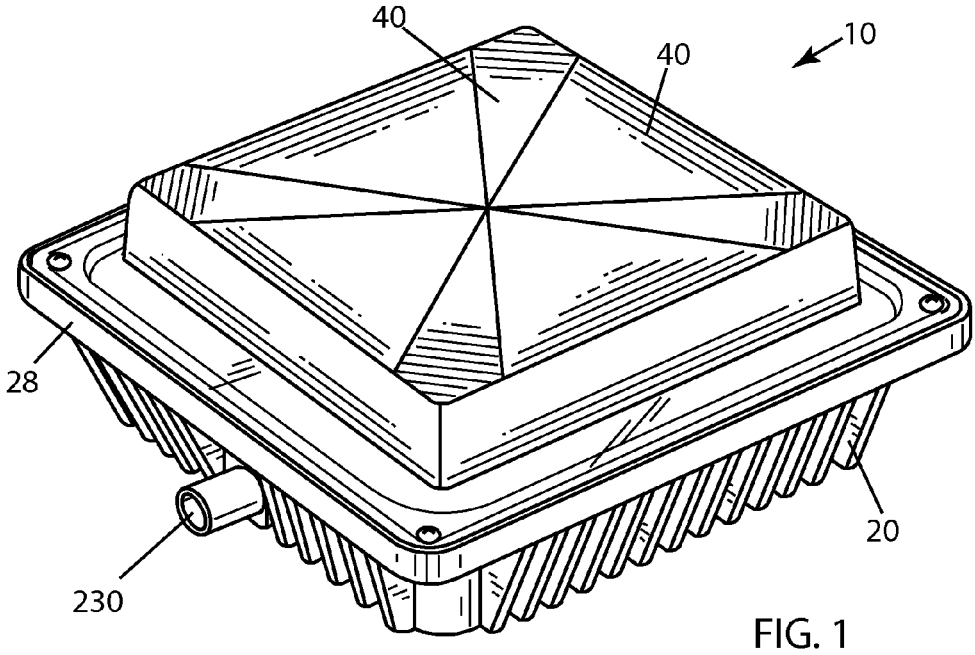
FIG. 1 is a front perspective view of one preferred embodiment of the LED lighting fixture in accordance with this invention.

FIGS. 1-11 illustrate preferred embodiments of an inventive LED lighting fixture 10. As best seen in FIGS. 3, 4, 7, 8 and 11, lighting fixture 10 includes a housing 20 having a hollow interior cavity 21 defined by a backwall 22 and a surrounding wall 23 extending therefrom to a forward edge 24. An LED illuminator 11 is mounted in housing 20. And, an LED-support structure 30 extends in interior cavity 21 from housing 20 to an LED-supporting surface 31 which positions LED illuminator 11 in a desired orientation and is spaced from backwall 22.

LED-support structure 30 is a heat sink transferring heat from LED illuminator 11 to housing 20. LED-support structure 30 is spaced from surrounding wall 23. LED lighting fixture 10 also includes three interior ribs 12 connecting LED-support structure 30 to surrounding wall 23.

The outer surface 25 of housing 20 includes a series of fins 26 extending outwardly therefrom. Fins 26 provide further heat dissipation from LED illuminator 11.

Figure 2:
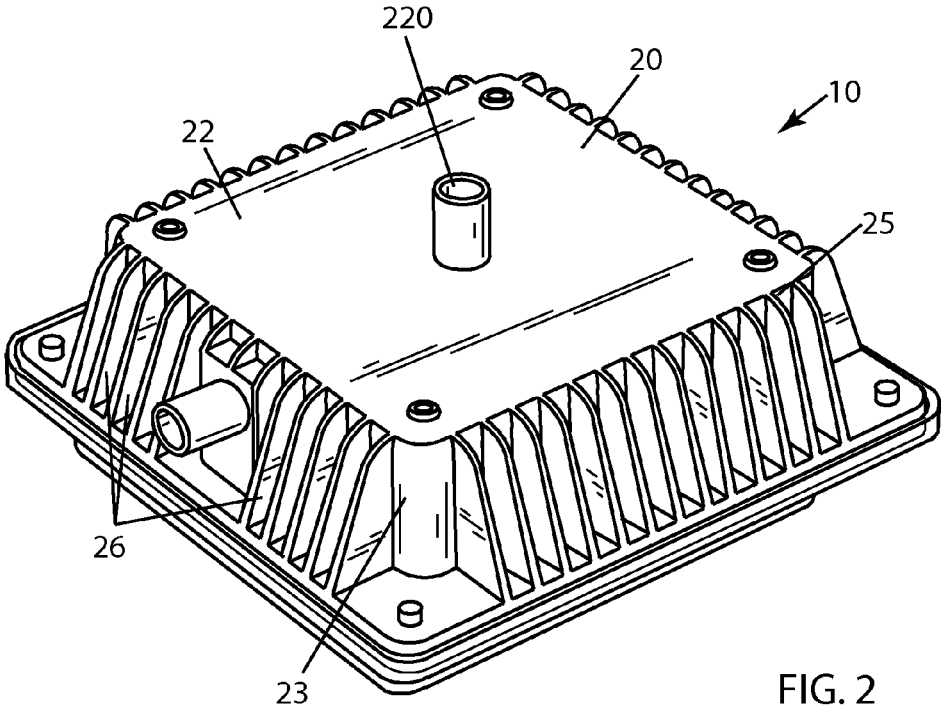
FIG. 2 is a rear perspective view of the LED lighting fixture of FIG. 1.
Figure 3:
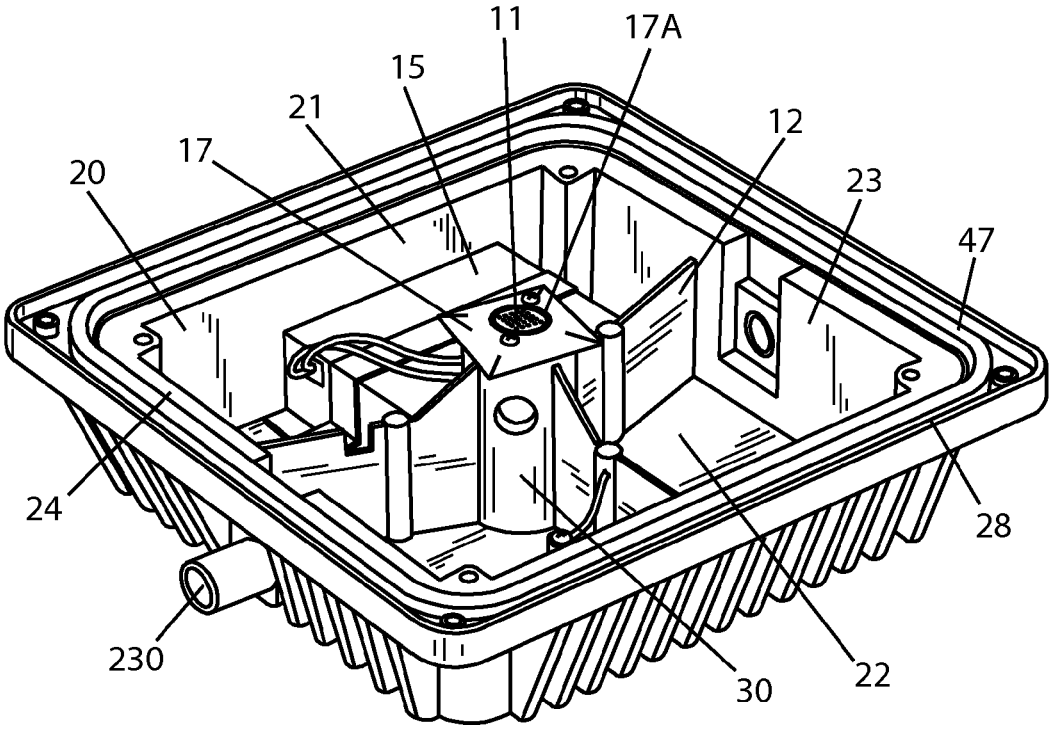
FIG. 3 is a perspective view of an interior cavity of the LED lighting fixture of FIG. 1.
Figure 4:
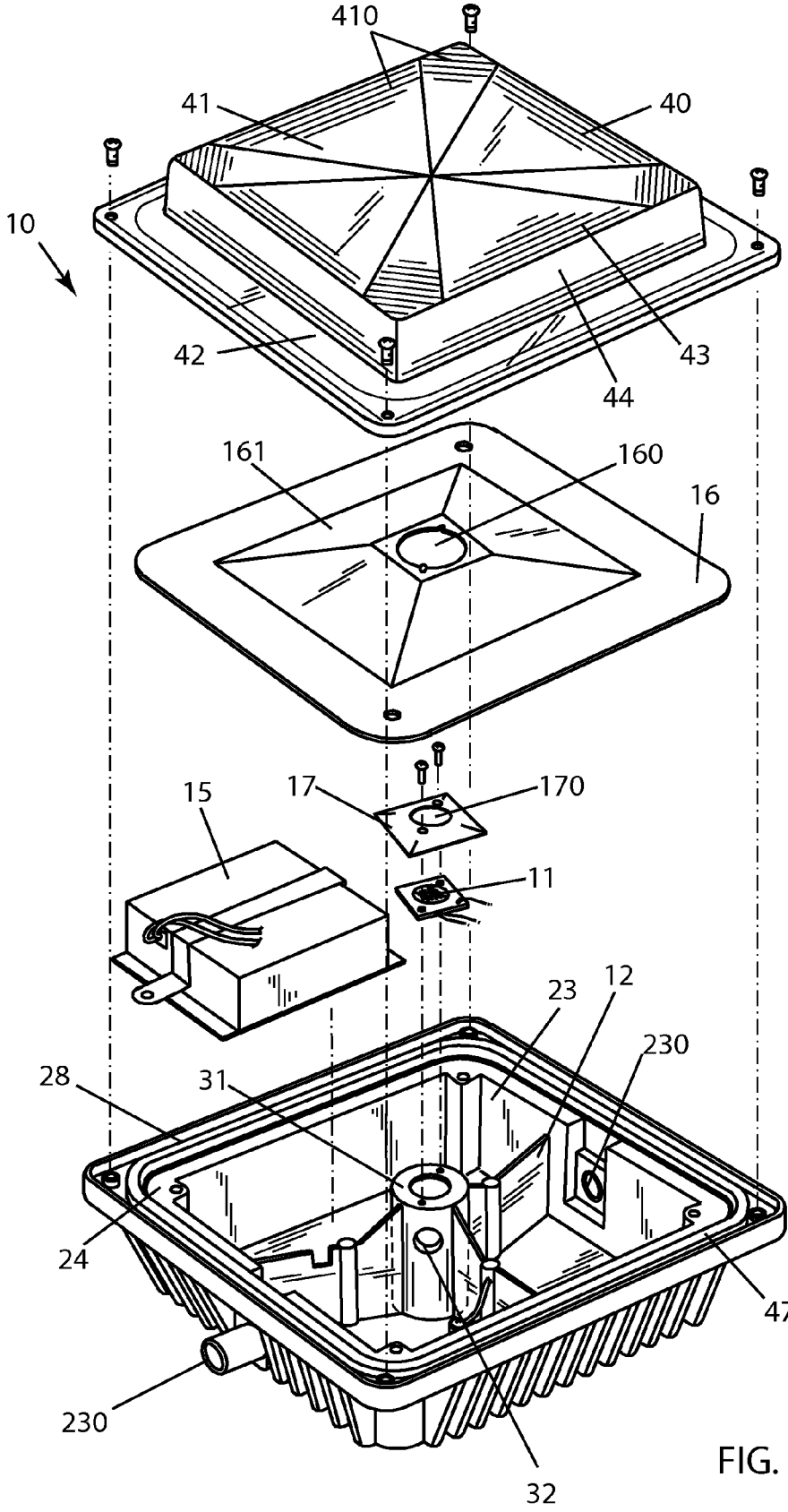
FIG. 4 is an exploded view of the LED lighting fixture the LED lighting fixture of FIG. 1.
Figure 5:
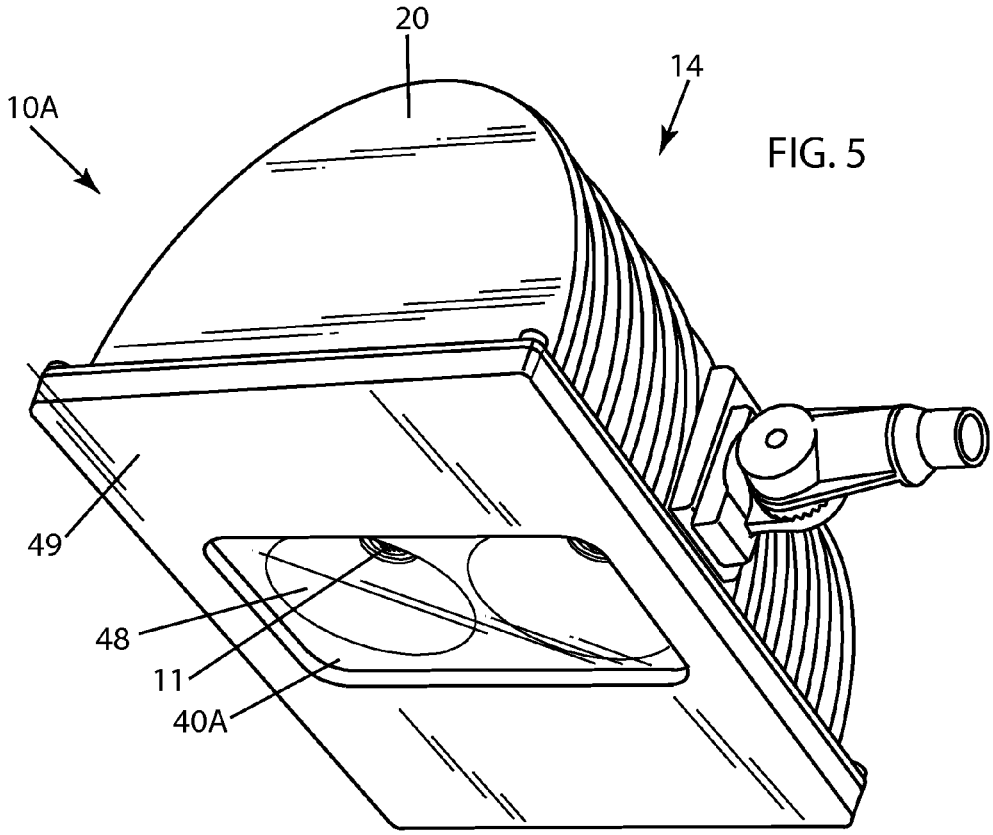
FIG. 5 is a front perspective view of a second preferred embodiment of the LED lighting fixture in accordance with this invention.

FIGS. 3, 4, 7, 8 and 11 further show LED-support structure 30 extending from backwall 22. It is seen in FIG. 4 that LED-support structure 30 is substantially hollow. And, FIG. 2 illustrates backwall 22 with an aperture 220 leading into hollow LED-support structure 30 which allows passage of wiring (not shown) into housing interior 21 and to LED illuminator 11. FIGS. 3 and 4 also show that hollow LED-support structure 30 defines an aperture 32 into housing interior 21 for the passage of wiring into housing interior 21 from backwall aperture 220.

LED lighting fixture 10 includes an LED driver 15 within housing interior 21. LED driver 15 is secured against housing 20 thereby transferring heat from driver 15.

FIG. 3 illustrates backwall 22 being substantially planar and surrounding wall 23 including a wire passage 230 into housing interior 21. Such configuration allows a plurality of similar fixtures to be mounted along a mounting surface, i.e., a wall, ceiling or other suitable surface, and to be powered with daisy-chain wiring.

In the embodiment shown in FIGS. 1-4, LED-supporting surface 30 supports LED illuminator 11 substantially at the level of forward edge 24 of surrounding wall 23. As best illustrated in FIG. 4, LED lighting fixture 10 includes a cover 16 closing housing interior 21. Such cover may be made of suitable metal to serve as an electrical closure for the housing interior. Cover 16 defines an LED aperture 160 exposing LED illuminator 11. Cover 16 has a substantially white outer surface 161 to reduce absorption of incident light. FIGS. 3 and 4 further show an illuminator cover 17 which is mounted immediately over LED illuminator 11 and defines a light aperture 170 sized substantially to match dimensions of a light-illuminating portion of LED illuminator 11.

LED lighting fixture 10 includes a lens member 40 over LED illuminator 11 and is sealingly connected to housing 20. Lens member 40 includes a lens portion 41 configured for broad distribution of LED-emitted light and a flange portion 42 about lens portion 41. Lens portion 41 includes a series of faucets 410 to refract LED-emitted light. Lens portion 41 is formed by a frontwall 43 and sidewalls 44 extending transversely therefrom. Flange portion 42 extends outwardly from sidewalls 44. Housing 20 includes an outward collar 28 about forward edge 24 of surrounding wall 23. Flange portion 42 of lens member 40 sealingly engages outward collar 28 to provide a weather seal for housing interior 21. LED lighting fixture 10 includes a flange-adjacent gasket 47 between flange portion 42 and outward collar 28.

Inventive LED lighting fixture 10A shown in FIGS. 5-8 includes a reflector cup 50 which is positioned at LED-supporting surface 31 and surrounds LED illuminator 11 to reflect LED-emitted light in a desired direction. In this embodiment, LED-supporting surface 31 is positioned such that distal edges 51 of reflector cup 50 are substantially at the level of forward edge 24 of surrounding wall 23.

FIGS. 5-8 illustrate fixture 10A having two LED illuminators 11 and including two reflector cups 50, one for each LED emitter 11. In this embodiment, LED-support structure 30A is positioned across interior cavity 21A substantially in the middle thereof. Internal ribs 12A extend between two opposite ends of LED-support structure 30A and an adjacent side of surrounding wall 23A. The embodiment shown in FIGS. 5-8 has a round back which is formed by the backwall smoothly transitioned into opposite sides of the surrounding wall.

Figure 6:
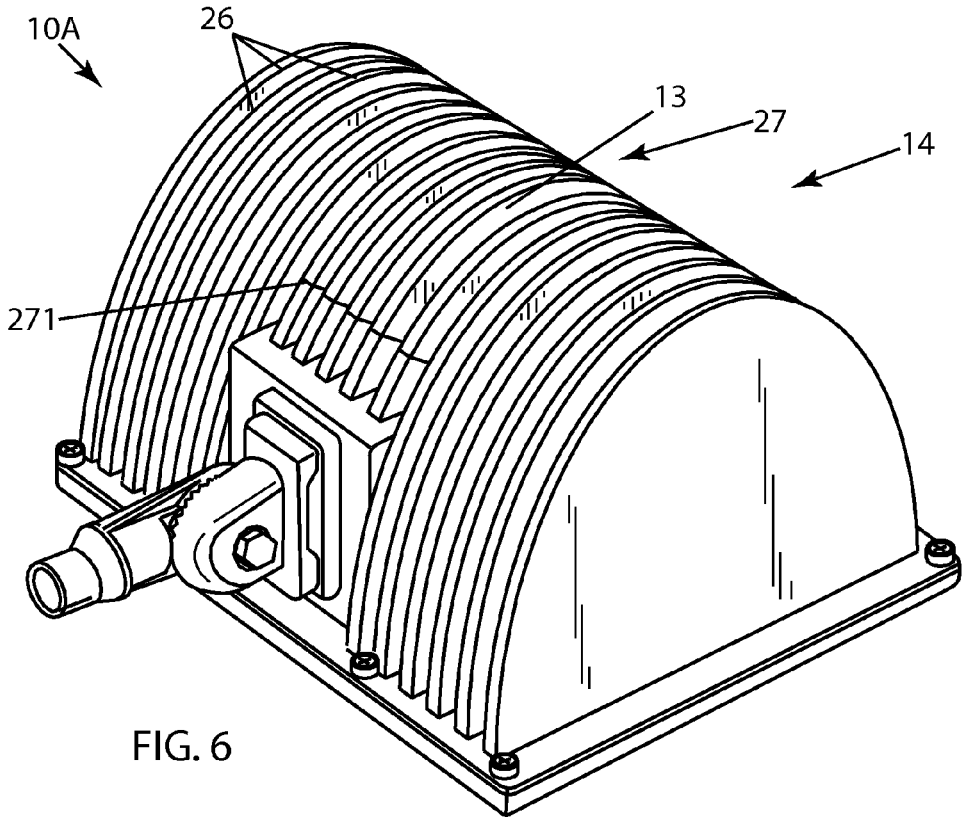
FIG. 6 is a rear perspective view of the fixture of FIG. 5.

Housing 20 and LED-support structure 30 are formed by casting with LED-support structure 30 extending from backwall 22. Housing 20 and LED-support structure 30 are integrally formed with outer surface 25 of backwall 22. Backwall 22 has a region 27 free of outer fins 26. It is seen in FIG. 6 that a finned insert 13 is secured to and filling fin-free region 27 of backwall 22 such that rear 14 of fixture 10A is uniformly finned. Line 271 indicates the interface between fin-free region 27 and finned insert 13.

Figure 9:
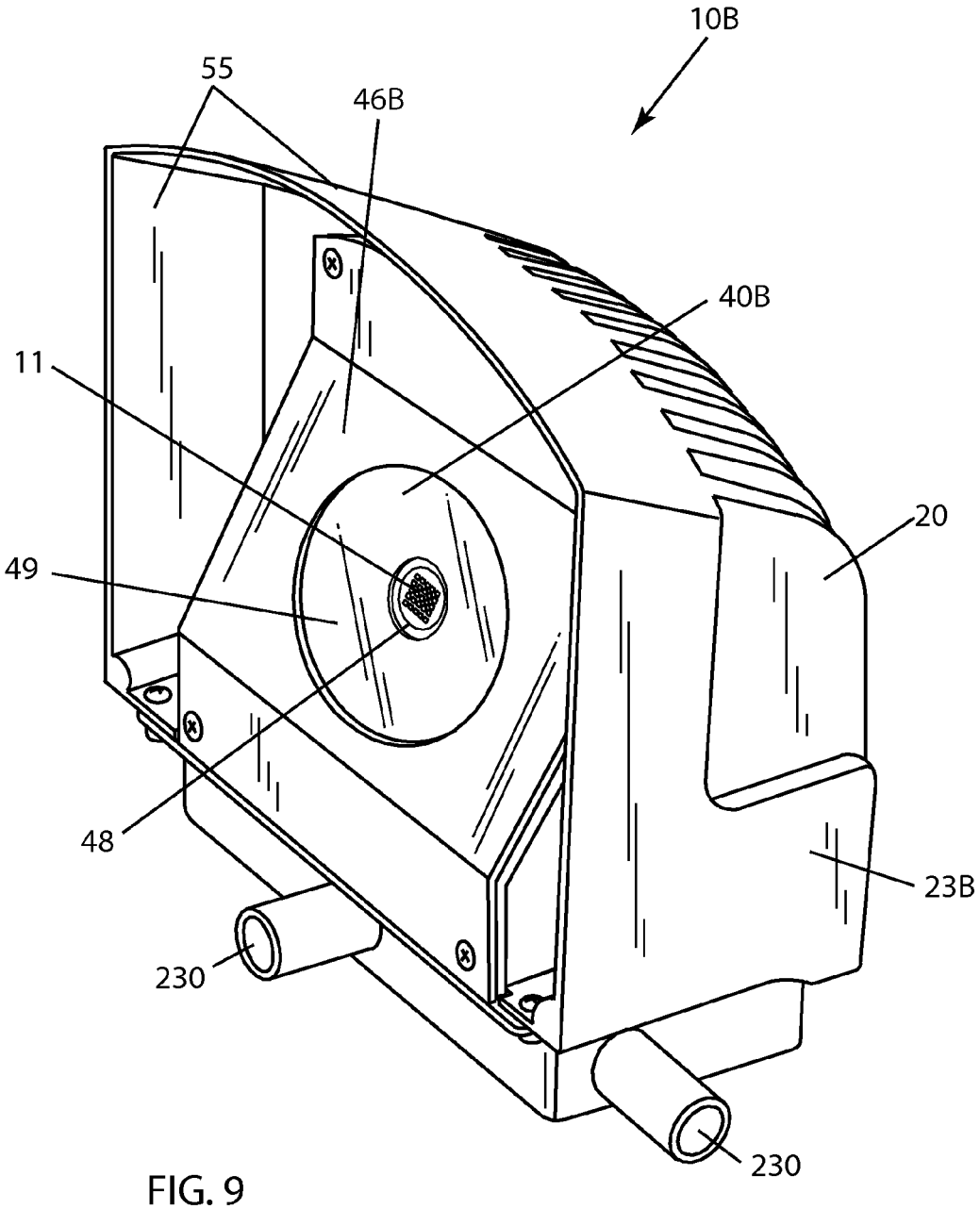
FIG. 9 is a front perspective view of a third embodiment of the LED lighting fixture in accordance with this invention.
Figure 10:
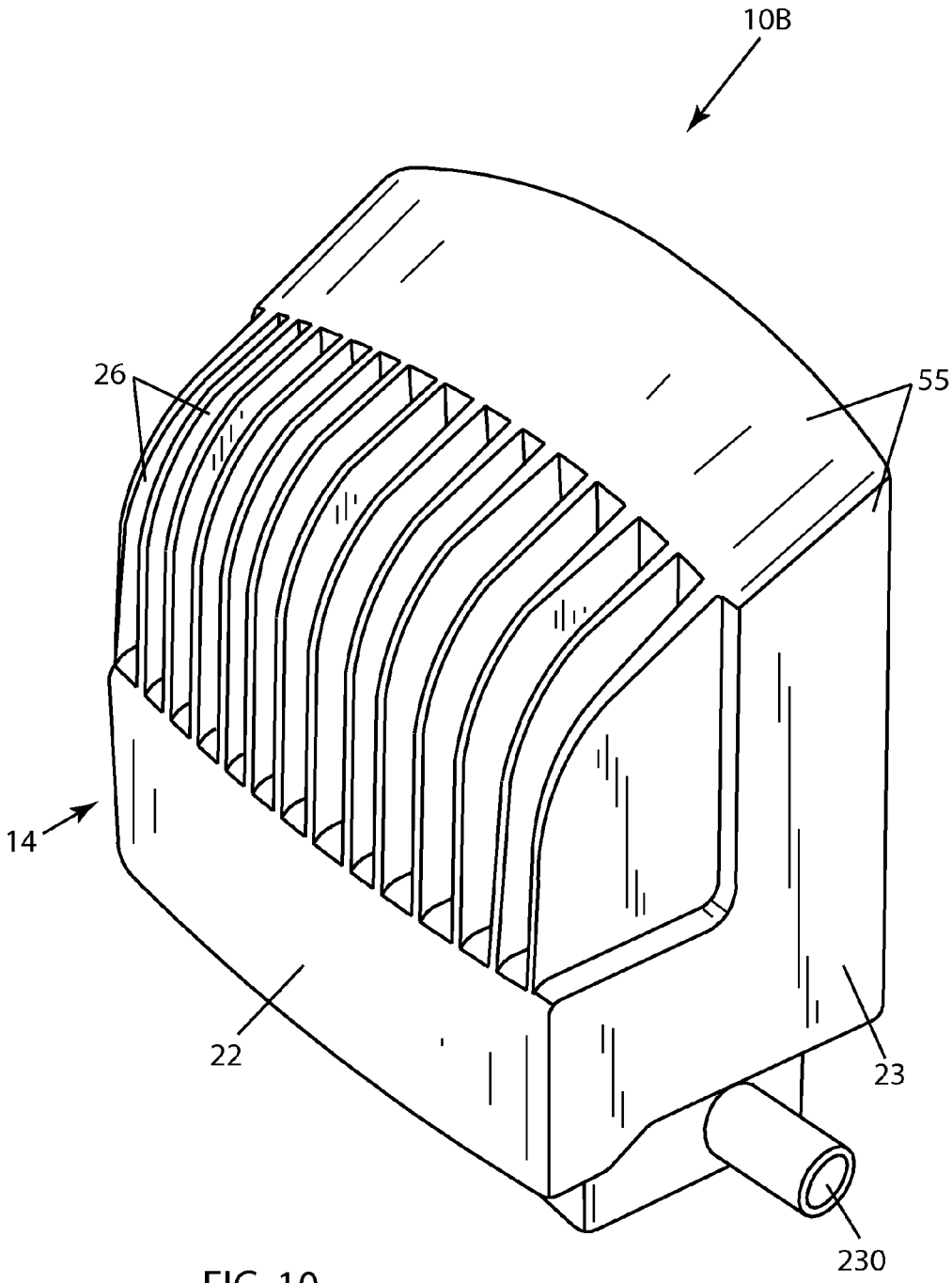
FIG. 10 is a rear perspective view of the fixture of FIG. 9.
Figure 11:
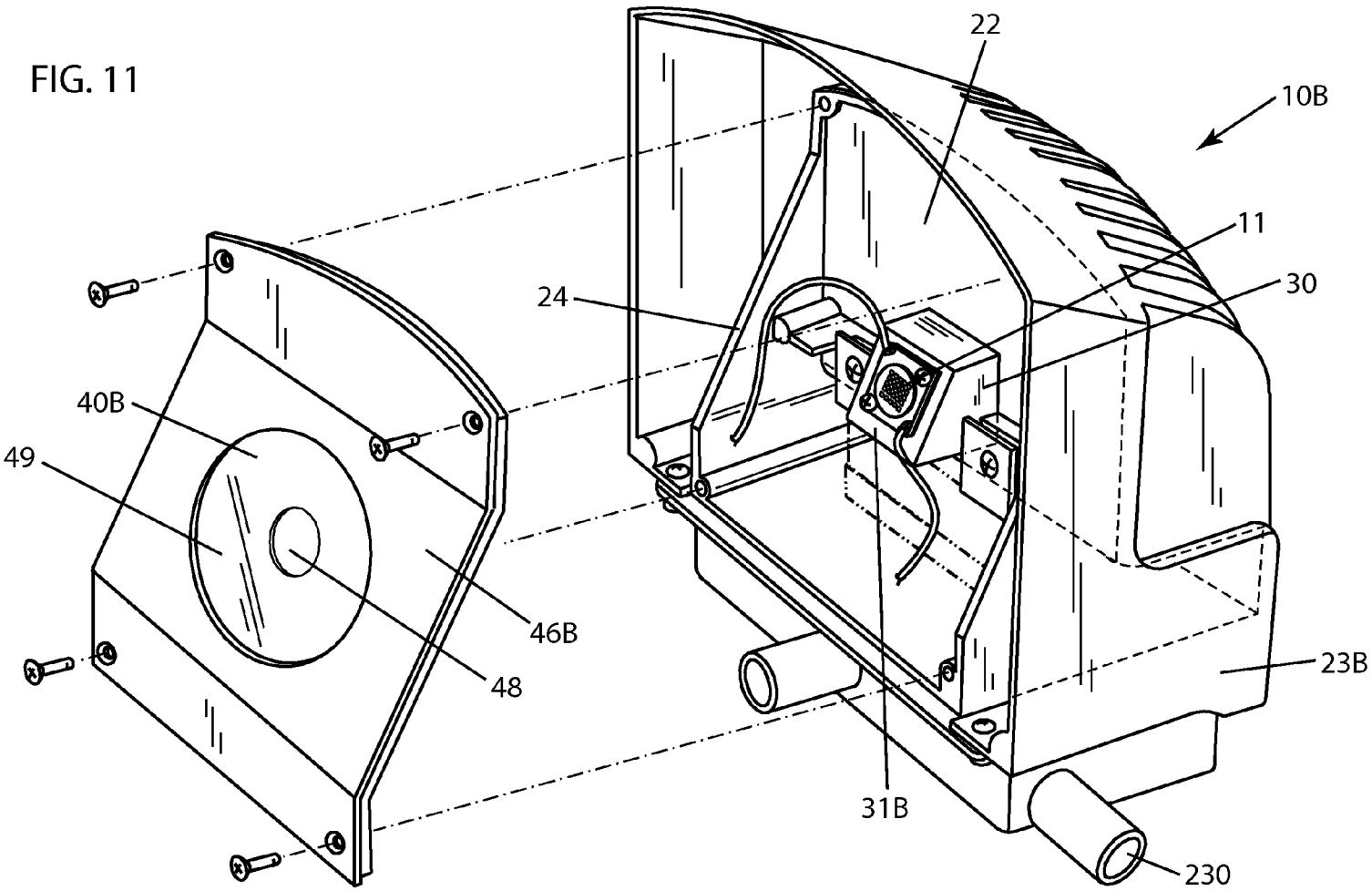
FIG. 11 is an exploded view of the LED lighting fixture of FIG. 9.

FIGS. 9-11 illustrate LED lighting fixture 10B which has LED-supporting surface 31B at an acute angle with respect to backwall 22 to support LED illuminator 11 at an angle for a desired orientation of LED-emitted light.

LED lighting fixtures 10A and 10B further include lens frames 46A (see FIG. 8) and 46B, respectively, over LED illuminator 11 and sealingly connected to housing 20. As seen in FIGS. 5, 8, 9 and 11, lens frames 46A and 46B each include a light-transmissive region 48 for transmitting LED-emitted light and an opaque region 49 covering housing interior 21.

In LED lighting fixture 10B, light-transmissive region 48 is formed by an aperture through a cover plate 49 which forms the opaque region surrounding the aperture. Lens member 40B overlays cover plate 49.

Figure 7:
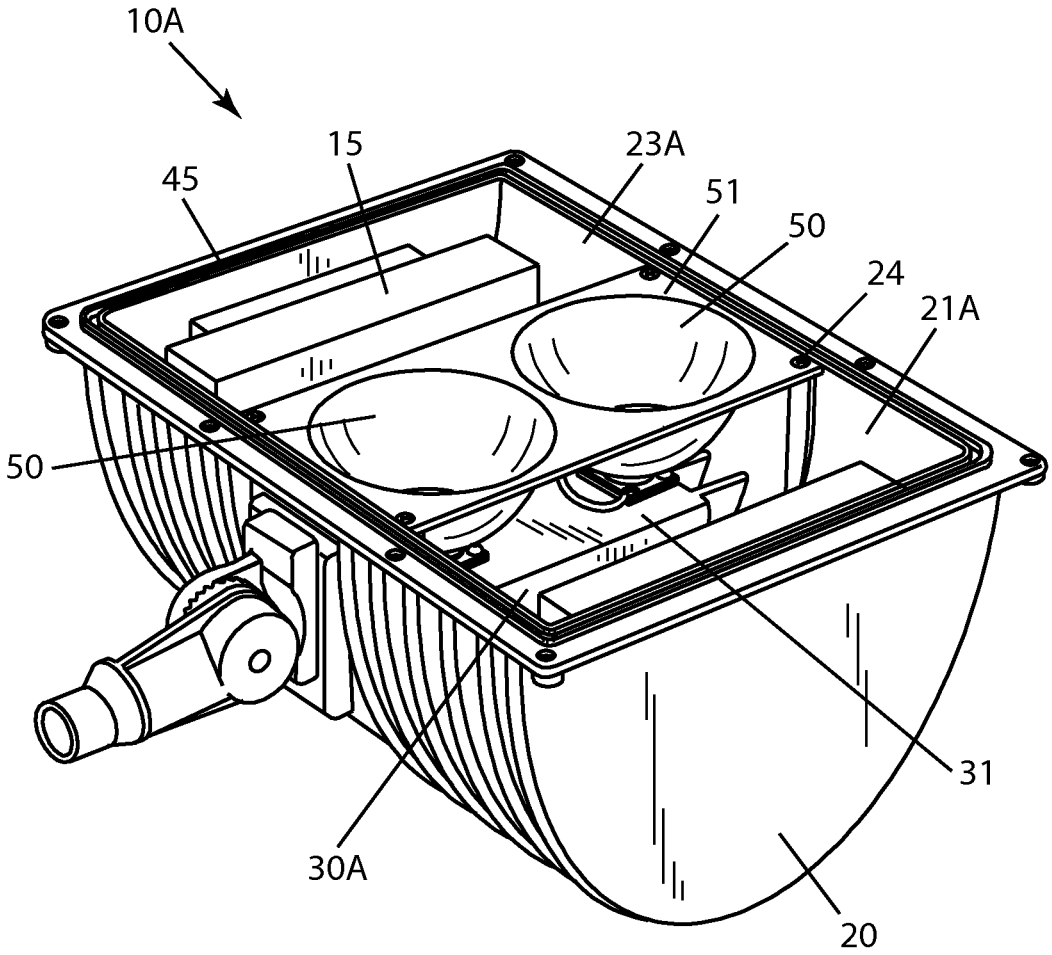
FIG. 7 is a perspective view of an interior cavity of the LED lighting fixture of FIG. 5.
Figure 8:
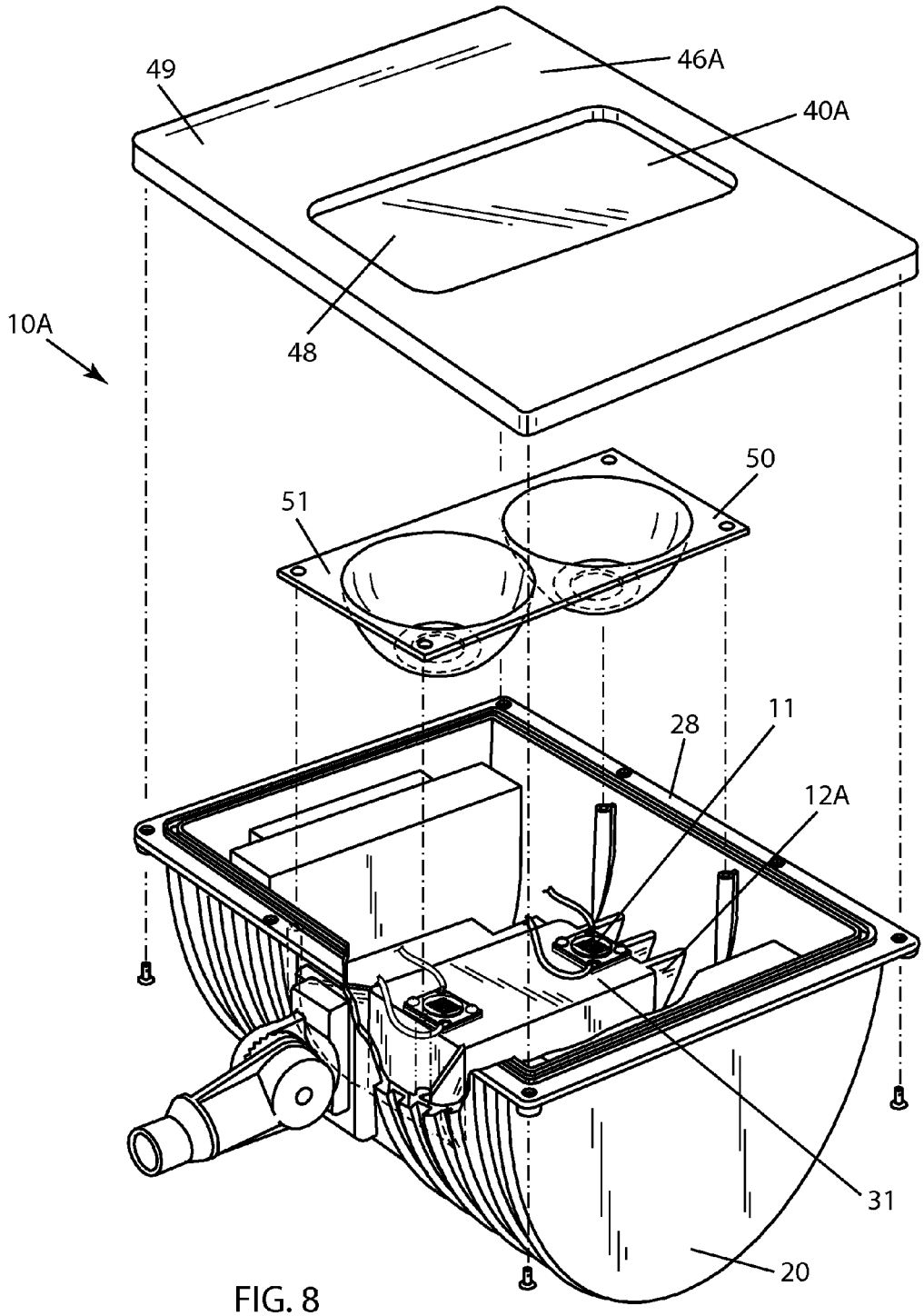
FIG. 8 is an exploded view of the LED lighting fixture the LED lighting fixture of FIG. 5.

In fixture 10A, lens frame 46A is substantially planar. It is also seen in FIGS. 7 and 8 that housing 20 includes an outward collar 28 about forward edge 24 of surrounding wall 23. Lens frame 46A sealingly engages outward collar 28. LED lighting fixture 10A further includes a collar-adjacent gasket 45 (seen in FIGS. 7 and 8) between lens frame 46A and outward collar 28.

FIG. 9 illustrates surrounding wall 23B including a shield portion 55 in position to intercept a portion of emitted light.

While the principles of the invention have been shown and described in connection with specific embodiments, it is to be understood that such embodiments are by way of example and are not limiting.

The invention claimed is:

1. In an LED lighting fixture including an LED illuminator mounted with respect to a housing, the improvement comprising:

the housing being a single piece having:

(a) a backwall defining a fixture outer surface and a surrounding wall extending from the backwall to a forward edge, the surrounding wall and the backwall together defining a single interior cavity; and (b) an LED-support structure integrally formed with the housing in the interior cavity and substantially spaced from the surrounding wall and extending from the backwall to an LED-supporting surface positioning the LED illuminator in a desired orientation and spaced from the backwall, the LED-support structure being a heat sink transferring heat from the LED illuminator to the housing; and an LED driver within the interior cavity and secured against the housing which transfers heat therefrom.

2. The LED lighting fixture of claim 1 including at least one interior rib connecting the LED-support structure to the surrounding wall.

3. The LED lighting fixture of claim 1 wherein the outer surface of the housing includes a series of fins extending outwardly therefrom and providing further heat dissipation from the LED illuminator.

4. The LED lighting fixture of claim 3 wherein:

the outer surface of the backwall has a region free of outer fins; and a finned insert is secured to such region of the backwall such that the rear of the fixture is uniformly finned.

5. The LED lighting fixture of claim 1 wherein:

the LED-support structure is substantially hollow; and the backwall is apertured, thereby allowing passage of wiring into the housing interior and to the LED illuminator.

6. The LED lighting fixture of claim 1 wherein:

the backwall is substantially planar; and the surrounding wall includes a wire passage into the housing interior, whereby a plurality of similar fixtures may be mounted along a mounting surface and powered with daisy-chain wiring.

7. The LED lighting fixture of claim 1 wherein the LED-supporting surface supports the LED illuminator substantially at the level of the forward edge of the surrounding wall.

8. The LED lighting fixture of claim 7 wherein the LED illuminator is a multi-chip LED module.

9. The LED lighting fixture of claim 7 further including a cover closing the housing interior, the cover defining an LED aperture exposing the LED illuminator.

10. The LED lighting fixture of claim 9 wherein the cover has a substantially white outer surface, thereby reducing absorption of incident light.

11. The LED lighting fixture of claim 7 further including a lens member over the LED illuminator and sealingly connected to the housing.

12. The LED lighting fixture of claim 11 wherein:

the lens member includes a lens portion configured for broad distribution of LED-emitted light and a flange portion about the lens portion; and the housing includes an outward collar about the forward edge of the surrounding wall, the flange portion of the lens member sealingly engaging the outward collar to provide a weather seal to the housing interior.

13. The LED lighting fixture of claim 12 further including a flange-adjacent gasket between the flange portion and the outward collar.

14. The LED lighting fixture of claim 1 wherein the LED illuminator is a multi-chip LED module.

15. The LED lighting fixture of claim 1 further including a reflector cup positioned at the LED-supporting surface and surrounding the LED illuminator to reflect LED-emitted light in a desired direction, the LED-supporting surface being positioned such that distal edges of the reflector cup are substantially at the level of the forward edge of the surrounding wall.

16. The LED lighting fixture of claim 15 further including a lens member over the LED illuminator and sealingly connected to the housing.

17. The LED lighting fixture of claim 16 wherein the lens member includes a light-transmissive region for transmitting LED-emitted light and a opaque region covering the housing interior.

18. The LED lighting fixture of claim 17 wherein:

the lens member is substantially planar; and the housing includes an outward collar about the forward edge of the surrounding wall, the lens member sealingly engaging the outward collar.

19. The LED lighting fixture of claim 18 further including a collar-adjacent gasket between the lens member and the outward collar.

20. The LED lighting fixture of claim 1 wherein the LED-supporting surface supports the LED illuminator at an acute angle with respect to the backwall.

21. The LED lighting fixture of claim 20 wherein the surrounding wall includes a shield portion in position to intercept a portion of emitted light.

22. The LED lighting fixture of claim 1 wherein the surrounding wall includes a shield portion in position to intercept a portion of emitted light.

* * * * *